US008986128B2

(12) United States Patent
Brantingham

(10) Patent No.: US 8,986,128 B2
(45) **Date of Patent: *Mar. 24, 2015**

(54) GOLF SWING PRACTICE APPARATUS

(76) Inventor: David E. Brantingham, Taipei (TW)

( * ) Notice: Subject to any disclaimer, the term of this patent is extended or adjusted under 35 U.S.C. 154(b) by 444 days.

This patent is subject to a terminal disclaimer.

(21) Appl. No.: 13/369,636

(22) Filed: Feb. 9, 2012

(65) Prior Publication Data

US 2012/0142442 A1 Jun. 7, 2012

Related U.S. Application Data

(63) Continuation-in-part of application No. 12/815,664, filed on Jun. 15, 2010, now Pat. No. 8,137,207.

(51) Int. Cl.

| | |
|---|---|
| ***A63B 69/36*** | (2006.01) |
| ***A63B 69/00*** | (2006.01) |
| ***A63B 24/00*** | (2006.01) |
| *A63B 71/06* | (2006.01) |

(52) U.S. Cl.

CPC ..... *A63B 69/3655* (2013.01); *A63B 69/0079* (2013.01); *A63B 69/3623* (2013.01); *A63B 24/0021* (2013.01); *A63B 71/0619* (2013.01); *A63B 2024/0031* (2013.01); *A63B 2220/18* (2013.01); *A63B 2220/34* (2013.01); *A63B 2220/805* (2013.01); *A63B 2225/50* (2013.01)

USPC ..... 473/140; 139/279

(58) Field of Classification Search

USPC ..... 473/138–150, 157, 160, 161, 162, 167, 473/168, 278, 279

See application file for complete search history.

(56) References Cited

U.S. PATENT DOCUMENTS

| | | | | | |
|---|---|---|---|---|---|
| 1,363,446 | A | * | 12/1920 | Vogel | 473/139 |
| 1,999,518 | A | * | 4/1935 | Stafford | 473/145 |
| 2,656,720 | A | | 10/1953 | Sonnett | |
| 2,778,645 | A | * | 1/1957 | Simjian | 473/141 |
| 3,658,343 | A | | 4/1972 | Rogers et al. | 473/161 |
| 3,690,673 | A | | 9/1972 | Occhipinti | 473/160 |
| 4,327,918 | A | | 5/1982 | Foster | |
| 4,343,469 | A | | 8/1982 | Kunita et al. | |
| 4,437,672 | A | | 3/1984 | Armantrout et al. | |
| 4,451,043 | A | | 5/1984 | Ogawa et al. | |
| 4,958,836 | A | | 9/1990 | Onozuka et al. | |
| 5,056,791 | A | | 10/1991 | Poillon et al. | |
| 5,121,923 | A | | 6/1992 | D'Allura | 473/140 |
| 5,165,691 | A | | 11/1992 | Cook | |
| 5,172,914 | A | | 12/1992 | Primerano | 473/171 |
| 5,217,228 | A | | 6/1993 | De Aguilar | |
| D353,179 | S | | 12/1994 | Pittmann | |
| 5,413,345 | A | | 5/1995 | Nauck | |
| 5,435,562 | A | | 7/1995 | Stock et al. | |
| 5,437,457 | A | | 8/1995 | Curchod et al. | |
| 5,451,059 | A | * | 9/1995 | Weis | 473/146 |
| 5,460,380 | A | | 10/1995 | Ober | |

(Continued)

*Primary Examiner* — Nini Legesse

(74) *Attorney, Agent, or Firm* — Wagenknecht IP Law Group PC

(57) ABSTRACT

A golf swing practice apparatus which includes a rotating drum having an optical sensor mounted inside the drum that is capable of swiveling in a direction perpendicular to the rotational direction of the drum and capable of detecting a change in swivel position or swivel angle; an elongated cord including a proximal end secured to the drum and a distal end secured to a golf ball; a base member having an impact area over which a user may swing a golf club; and a frame structure secured to the base member and to the rotating drum whereby the frame structure holds the rotating drum in an elevated position above the impact area.

17 Claims, 22 Drawing Sheets

(56) References Cited

U.S. PATENT DOCUMENTS

| | | | | |
|---|---|---|---|---|
| 6,056,645 | A | 5/2000 | Servatius | 473/161 |
| 6,059,668 | A | 5/2000 | Marley, Jr. | |
| 6,257,989 | B1 | 7/2001 | Tortola et al. | 473/140 |
| 6,338,682 | B1 | 1/2002 | Torchia et al. | 473/160 |
| 6,458,038 | B1 | 10/2002 | Lin | |
| 6,569,026 | B1 | 5/2003 | Weis | 473/139 |
| D500,544 | S | 1/2005 | Wu | |
| 6,872,150 | B2 | 3/2005 | Welch | |
| 7,214,136 | B1 | 5/2007 | Perry et al. | 473/139 |
| 8,137,207 | B2 * | 3/2012 | Brantingham | 473/140 |
| 2005/0107179 | A1 | 5/2005 | Munshi | |
| 2007/0191128 | A1 | 8/2007 | Tirol | 473/150 |
| 2007/0224583 | A1 | 9/2007 | Humphrey | |
| 2009/0215548 | A1 | 8/2009 | Broering | |

* cited by examiner

GOLF SWING PRACTICE APPARATUS

CROSS-REFERENCE TO RELATED APPLICATIONS

This invention is a continuation-in-part of U.S. patent application Ser. No. 12/815,664, filed Jun. 15, 2010; the contents of which are herein incorporated by reference in their entirety.

TECHNICAL FIELD

The present invention relates generally to golf swing practice apparatuses, and more specifically to a golf swing practice apparatus including a rotating drum having an internal optical sensor mounted to a swivel and capable of detecting changes in swivel position for use in simulating a trajectory of a struck golf ball.

BACKGROUND OF THE INVENTION

The game of golf is played on a golf course which usually has eighteen holes. Each hole is a selected distance from a tee-box. A golfer initially hits the ball toward a green that provides a hole into which the ball is to be ultimately directed. In order to reach the green, the golfer employs clubs, either woods or irons, which have different lifts and weight so that the ball flies a calculated distance. Once on the green, the golfer uses a putter to roll the ball until it is ultimately hit into the hole.

It is known that a golfer's game can be improved by practicing hitting the golf ball. While it is relatively easy to practice putting, it is more difficult hitting longer golf shots such as would occur from the tee-box or fairway to the green. This practice hitting or driving is most frequently done at driving ranges. However, using a driving range can be time-consuming, expensive and inconvenient. Additionally, since driving ranges are located outdoors, bad weather may prevent their use.

In light of these difficulties, several golf swing practice devices have been developed to be utilized in a confined area. Such devices include tethered golf ball trainers, laser alignment club trainers, catch nets, and sensor-driven computer simulation systems.

Tethered golf ball trainers are provided by U.S. Pat. Nos. 2,656,720, 4,958,836, 5,460,380, US 2005/0107179, D353, 179 and D500,544. Tethered trainers provide the opportunity to use a normal golf club to practice swinging at a golf ball. However, their tether and frame structures often cannot withstand the forces associated with club impact at club head speeds above 70 miles per hour. Additionally, missed swings striking the tether cord may result in lassoing of the tether cord around the golf club head, which can damage the golf club. The club head speed of an average golfer's swing is approximately 80 to 95 miles per hour. However, the speed of an average touring professional golfer's swing is approximately 110 to 125 miles per hour.

Laser alignment club trainers are provided by U.S. Pat. Nos. 5,165,691, 5,217,228, 5,435,562, 6,059,668, 6,458,038, 6,872,150 and US 2009/0215548. Laser alignment club trainers allow a user to visualize the theoretical path of a golf ball based on the orientation of golf club head. However, such trainers require special golf clubs with lasers mounted on or in the shaft or club head.

Sensor-driven computer simulation systems and catch nets are provided by U.S. Pat. Nos. 4,327,918, 4,343,469, 4,437,672, 4,451,043, 5,056,791, 5,437,457 and US 2007/0224583.

Sensor-driven computer simulation systems simulate real play by employing a series of optical sensors which gather information about a swing, computing the theoretical path of the golf ball using such information, and displaying the path to a user. However, simulation systems and catch nets are expensive, difficult to install, and require a large space. Additionally, systems employing catch nets require a user to fetch the ball and reset it after each swing.

As such, it may be appreciated that there continues to be a need for a new and improved home-use golf swing practice apparatus which can safely accommodate swings at club head speeds in excess of 70 miles per hour without employing large catch nets or expensive sensor driven computer simulation systems.

SUMMARY OF THE INVENTION

The present invention addresses the deficiencies inherent in current golf practice devices by providing a golf swing practice apparatus which includes an optical sensor mounted on a swivel within a rotating drum. More specifically, a first aspect of the present invention provides a golf swing practice apparatus which includes a rotating drum having an optical sensor mounted inside the drum that is capable of swiveling in a direction perpendicular to the rotational direction of the drum and capable of detecting a change in swivel position or swivel angle; an elongated cord including a proximal end secured to the drum and a distal end secured to a golf ball; a base member having an impact area over which a user may swing a golf club; a frame structure secured to the base member and to the rotating drum whereby the frame structure holds the rotating drum in an elevated position above the impact area; and a consol for optionally calculating and displaying swing data. The apparatus calculates predicted trajectory information of the golf ball when leaving the golf club swung by the user by converting a detected change in swivel position to a corresponding ball angle.

Data from the optical sensor is preferably wirelessly transmitted to the console and the console may display an approximate angle at which the ball left the users club head. In addition, a series of light emitting diodes (LEDs) can display the predicted trajectory information by selectively lighting at least one LED.

The golf swing practice apparatus can also include a means for raising the impact area after the golf ball is struck by the user to interrupt rotation of the golf ball.

In some embodiments the apparatus includes a means for measuring forces on the rotating drum or speed of rotation caused by the motion of the golf ball after the golf ball is struck by the user; a means for computing a theoretical spatial location relative to a fairway to which the golf ball would travel if the golf ball were not tethered to the rotating drum; and a display for displaying a theoretical spatial location to the user. In some embodiments the means of measuring the speed of rotation of the rotating drum includes a magnet secured to the rotating drum; and a magnet sensor secured to the frame structure, which is capable of monitoring rotation of the magnet.

In another aspect of the invention an optical drum for use with a golf swing practice apparatus is provided, which includes a drum core; a swivel ring positioned around the drum core and capable of swiveling perpendicular to a rotational direction of the drum, wherein the swivel ring includes an optical sensor capable of detecting a change in swivel position or angle; a tether means for tethering a golf ball to the center swivel ring; and a wireless transmitter or electronic circuitry to electrically transmit the change in swivel position to a receiver.

In another aspect of the invention a base member for use with a golf swing practice apparatus is provided, which includes an impact area at least partially detached from a surrounding golf base, wherein the impact area provides surface for impacting a golf club during a golf swing and the surrounding base provides a surface on which the user addresses a golf ball; and a means for raising the impact area from the surrounding golf base. In some embodiments, the impact surface includes a retractable center flap attached to an attachment site on a slide mechanism of the means for raising the impact area, which induces raising of the impact surface upon sliding of the sliding mechanism. In some embodiments, a push/pull lever bracket mounted on a bottom side of the mat provides a mechanism for raising the impact area.

BRIEF DESCRIPTION OF THE DRAWINGS

Those of skill in the art will understand that the drawings, described below, are for illustrative purposes only. The drawings are not intended to limit the scope of the present teachings in any way.

DETAILED DESCRIPTION

Figure 1:
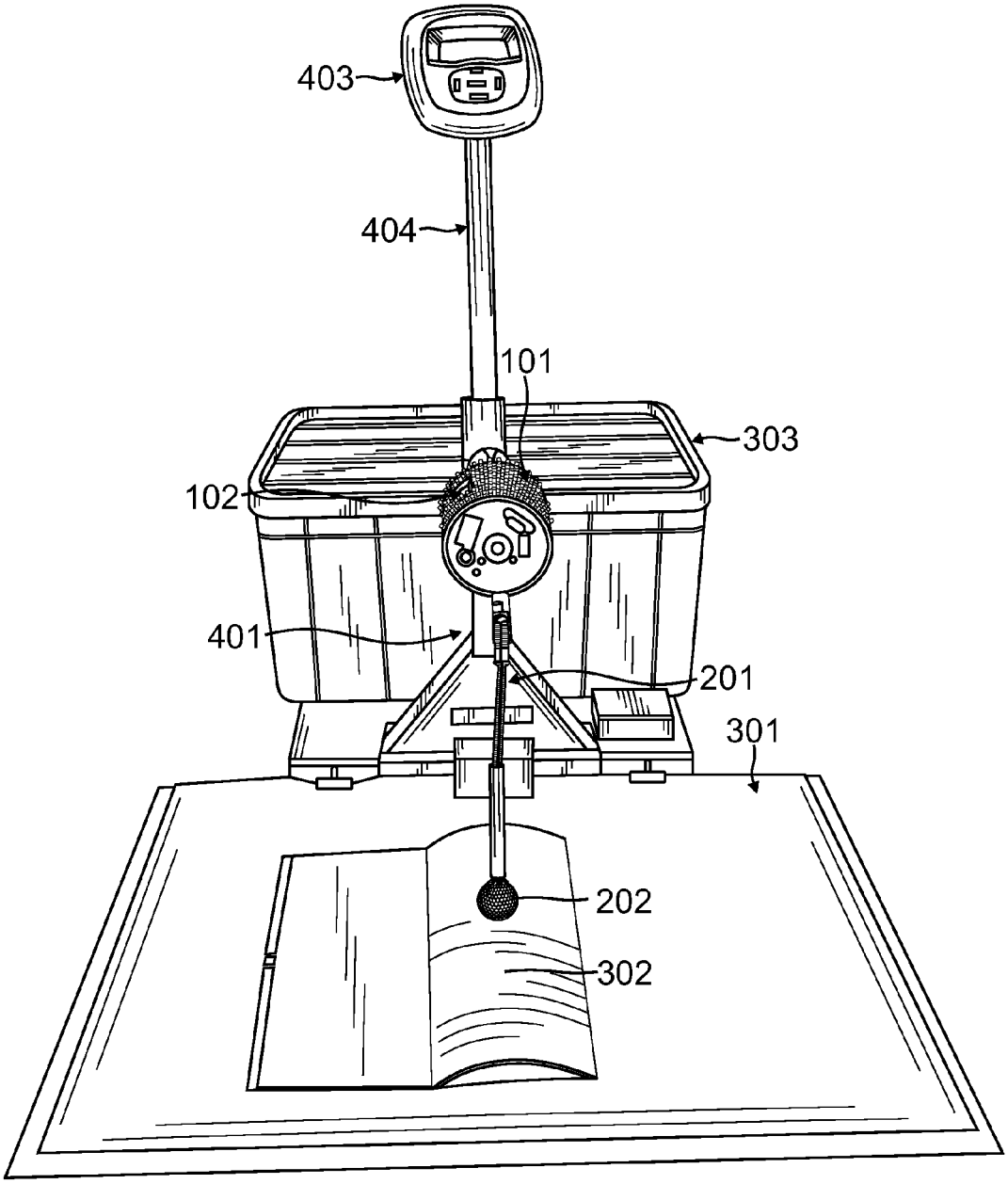
FIG. 1 is a front perspective view of an embodiment of a golf practice apparatus including a laser generating means 102 for visually monitoring the path of a golf ball 202.

The invention provides a golf swing practice apparatus that determines a trajectory of a struck golf ball and displays the results for viewing by a user. This is accomplished in part through the use of a rotating drum that is suspended above a platform and tethered to a golf ball. In one embodiment, the rotating drum includes a plurality of laser generating means that project light outward and thus permits the user to visually determine whether the ball trajectory is straight, left of center, right of center and like by visually monitoring the projected light beams. In a second embodiment, the rotating drum includes an internal optical sensor, which is mounted within the optical drum on a swivel. By mounting the optical sensor on a swivel the optical sensor itself detects changes in swivel position or angle, which corresponds to theoretical ball trajectory. Thus, the optical sensor detects left or right pivoting of the tethered ball and thus monitors whether the ball trajectory is straight, left of center, right of center and the like. Ball trajectory data can be combined with rotational velocity or force measurement to determine the distance and thus virtual position of a struck ball. Measurement of predicted ball speed is accomplished by rotational measurement of the drum.

Referring generally to FIGS. 1-6, a first aspect of the present invention provides a rotating drum 101, an elongated cord 201, a golf ball 202, a base member 301, and a frame structure. Rotating drum 101 includes a plurality of laser generating means mounted thereon. Elongated cord 201 includes a proximal end secured to rotating drum 101 and a distal end secured to golf ball 202 whereby golf ball 202 is tethered to rotating drum 101. Base member 301 includes an impact area 302 over which a user may swing a golf club. The frame structure includes frame structure base 401 and frame structure arm 402. Frame structure base 401 is secured to base member 301 and frame structure arm 402 is secured to rotating drum 101 whereby the frame structure holds rotating drum 101 in an elevated position above base member 301. Rotating drum 101 is secured to frame structure arm 402 whereby rotating drum 101 can rotate freely about frame structure arm 402. Rotating drum 101 and golf ball 202 rotate around frame structure arm 402 when golf ball 202 is struck by a user to impart flight thereto. In some embodiments, while rotating drum 101 and golf ball 202 rotate around frame structure arm 402, at least one laser generating means 102 generates a laser beam which propagates substantially parallel along the path of golf ball 202 and at least one laser generating means 103 generates a laser beam which propagates parallel to a theoretical path of a fairway.

In some embodiments, elongated cord 201 is doubled on itself to define a distal cord loop and the distal cord loop passes through two holes in golf ball 202 to secure golf ball 202 to elongated cord 201. Preferably, the two holes are located on golf ball 202 at an angle relative to each other between 45° and 90°. Preferably, elongated cord 201 is a 4 mm nylon rope doubled on itself and golf ball 202 is a standard two-piece golf ball. Preferably, a distal portion of elongated cord 201 is surrounded by a resilient structure 203. Preferably, resilient structure 203 is 130-150 mm in length and is constructed of a polymer, which can be opaque but is preferably transparent. Exemplary polymers include polypropylene, a variety of rubbers, and the like. In some embodiments two golf balls with elongated cords of different lengths are provided; one 450-460 mm long for use with woods and one 475-485 mm long for use with irons.

The elongated cord 201 can be connected to the drum 101 using a variety of approaches. In some embodiments, the proximal end of elongated cord 201 is threaded in a figure 8 pattern through a female insert 204. The proximal end strands of the cord 201 are then crimped together with a steel clip 205. Female insert 204 threads into a male insert 104, as discussed below. Preferably, female insert 204 and male insert 104 are constructed of steel.

Figure 7B:
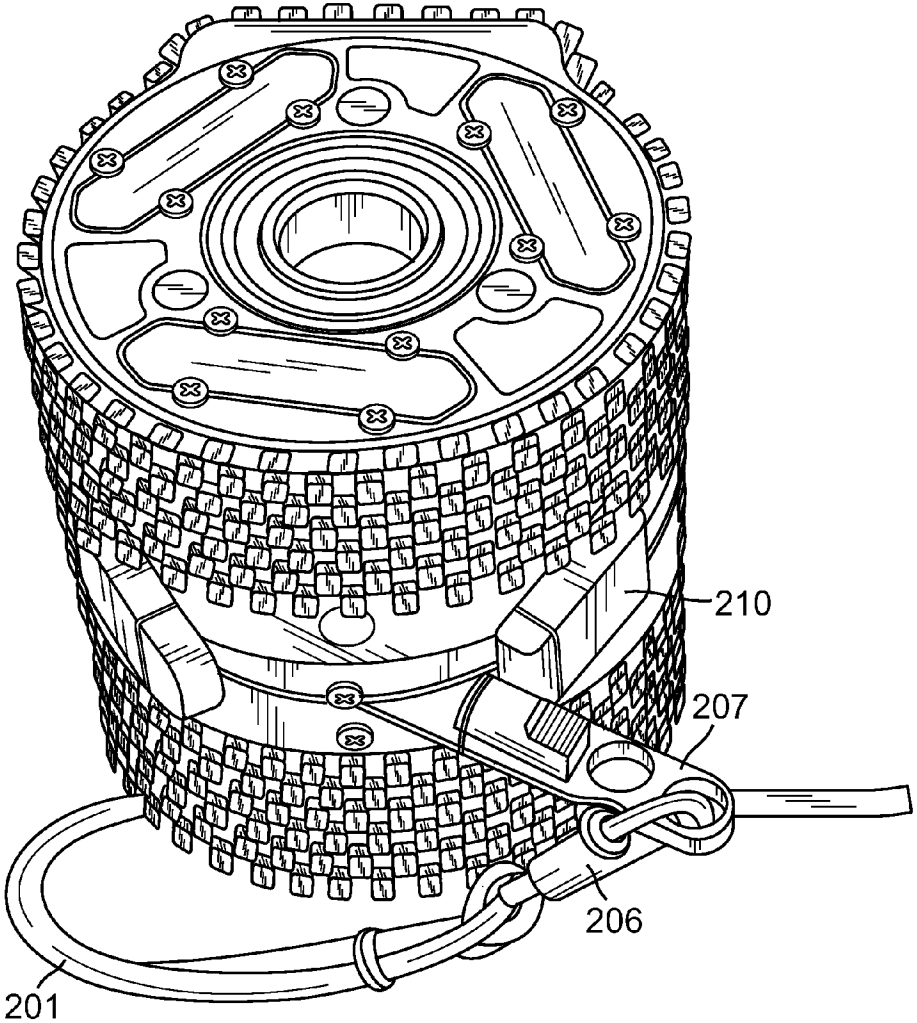
FIGS. 7A-B show an elongated cord 201 attached to a D-ring connector 206, which connects to an adapter 207.
Figure 7A:
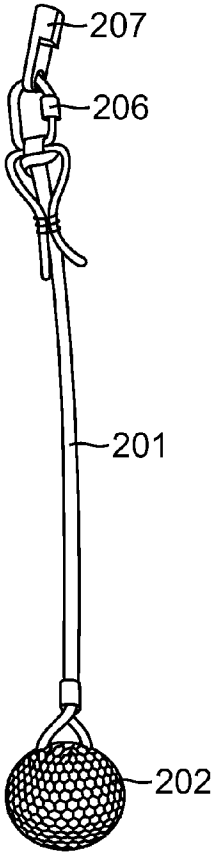

Another approach is shown in FIGS. 7A-B, which shows an elongated cord 201 coupled to a D-ring connector 206 that can selectively connect to an adapter 207, preferably having at least two apertures positioned one above the second to provide at least two ball heights, such as a first higher ball height for woods and a second lower ball height for irons. Alternatively, providing at least two apertures permits the user to compensate for stretching of the cord 201, which depending on its materials may occur during the life of the device. Distances between the center of the two apertures can vary but in some instances is between about 10 mm and 40 mm but more preferably about 15 mm to about 35 mm when selecting between a wood configuration or an iron configuration or in some instances less than 10 mm when compensating for a stretched cord 201. The skilled artisan will appreciate that by adding additional apertures and reducing their diameters the distances between neighboring apertures could be decreased and thus precision of ball positioning can be increased.

Figure 3:
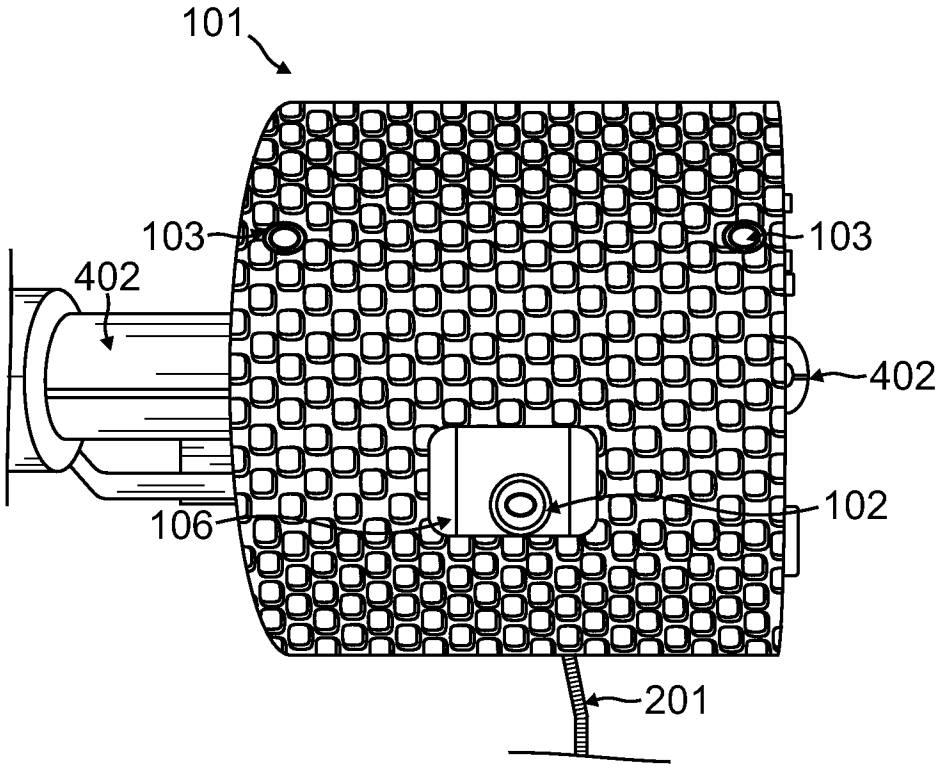
FIG. 3 is an enlarged top perspective view of one embodiment of rotating drum 101.

Referring to FIG. 3, in some embodiments, the plurality of laser generating means are laser generating diodes. Preferably, the plurality of laser generating means include three laser generating means—one laser generating means 102 and two laser generating means 103. Preferably, laser generating means 102 and 103 illuminate only when rotating drum 101 is rotating, which saves battery life and prevents the laser beams from distracting the user at address. As rotating drum 101 rotates around frame structure arm 402, laser generating means 102 projects a green laser beam which follows the plane of rotating golf ball 202. Concurrently, laser generating means 103 project two red lines which simulate the path of a fairway. The resulting visual cue, which appears as three continuous laser beams on the floor, ceiling and adjacent walls, provides instant visual feedback to the user as to how square or straight golf ball 202 was hit at impact. If the green laser line stays within the two red laser lines, then the user knows the ball was hit straight.

Figure 4:
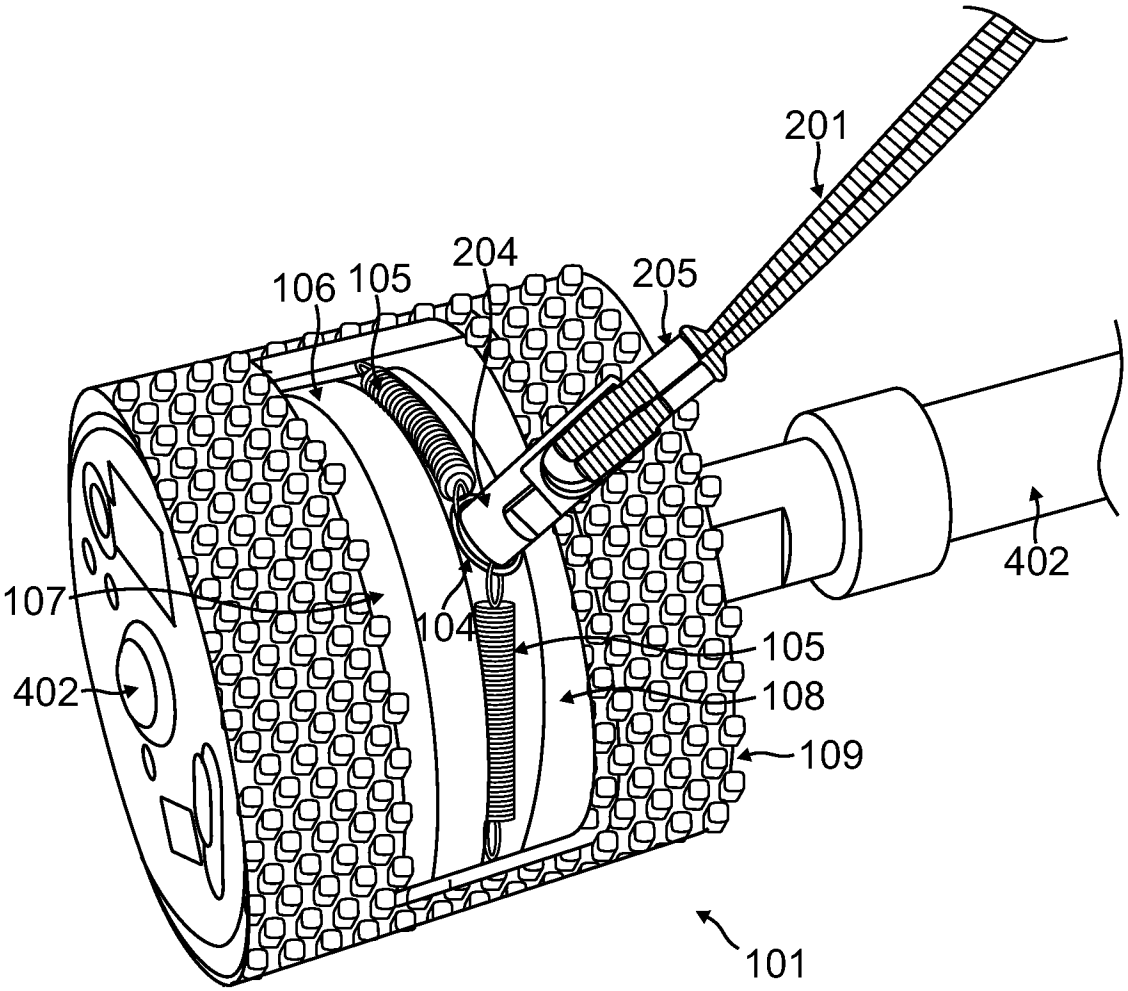
FIG 4 is a bottom perspective view thereof.

Turning to FIG. 4, in some embodiments, rotating drum 101 includes a drum core 108 which rotationally engages frame structure arm 402, a center swivel ring 106 which encircles drum core 108, and a drum cover 109 which is affixed to drum core 108 and covers drum core 108 and center ring 106. Referring to FIGS. 3 and 4, center swivel ring 106 can move from side to side over drum core 108 along the axis of rotating drum 101. Laser generating means 103 are mounted on drum core 108 perpendicular to the axis of rotating drum 101 such that laser generating means 103 project two red lines perpendicular to the axis of rotating drum 101 to outline a fairway. Laser generating means 102 is mounted on center swivel ring 106 and the proximal end of elongated cord 201 is secured to center swivel ring 106 such that the forces applied by rotating golf ball 202 cause center swivel ring 106 to move from side to side over drum core 101 and the green line projected by laser generating means 102 to follow the plane of rotation of golf ball 202. Drum cover 109 includes apertures exposing laser generating means 102 and 103 and male insert 104. Male insert 104 is secured to center swivel ring 106 by means of a pin 107 and is located in a crevice along a portion of the circumference of center swivel ring 106. Elongated cord 201 is secured to rotating drum 101 by means of female insert 204 which threads into male insert 104. Male insert 104 can swing freely in the crevice in directions perpendicular to the axis of rotating drum 101 to absorb ball impact forces. Springs 105 may be secured to either side of male insert 104 and to the ends of the crevice to further absorb impact forces as shown in FIG. 4; however as picture in FIG. 7B, impact bumpers 210 may be provided as an alternative to springs or in addition to springs.

In some embodiments, the frame structure is constructed of steel. Preferably, frame structure arm 402 is height-adjustable and is constructed of solid steel which can safely withstand impact and centrifugal forces induced by a 145 miles per hour swing.

In some embodiments, the frame structure includes an upper frame structure 404 affixed at a proximal end to frame structure base 401 and at a distal end to a display means 403. Display means 403 may display any or all of the following: club selection, ball flight distance, club head speed, ball angle, driving accuracy percentage, total swings, best shots, and averages.

In the some embodiments, base member 301 is a two-layered mat. The top layer is a turf mat and the bottom layer is a 3-7 mm rubber mat which adds rigidity and cushions a swing impact. Both layers may be soft and foldable. Alternatively, the bottom layer may be a constructed of rigid plastic.

Figure 2:
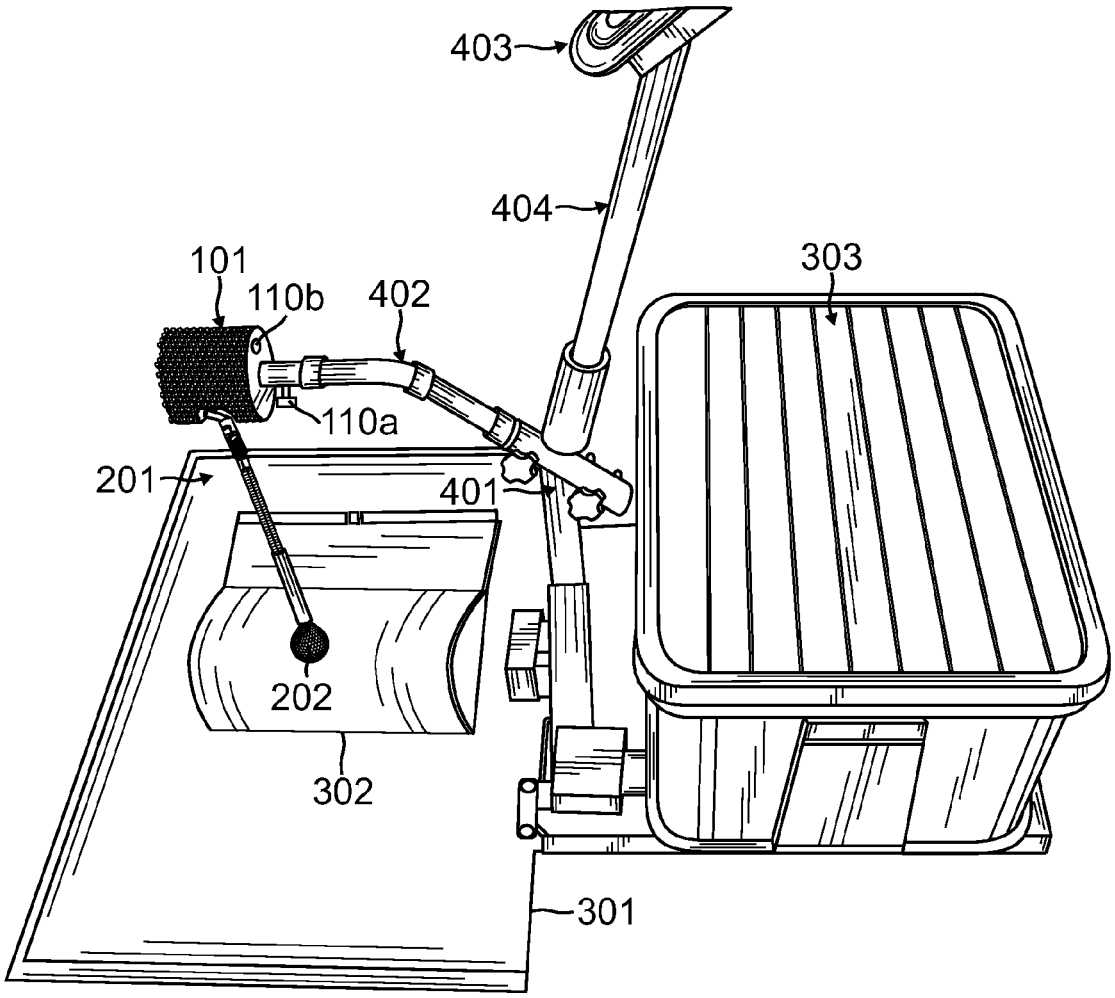
FIG. 2 is a side perspective view thereof.
Figure 5:
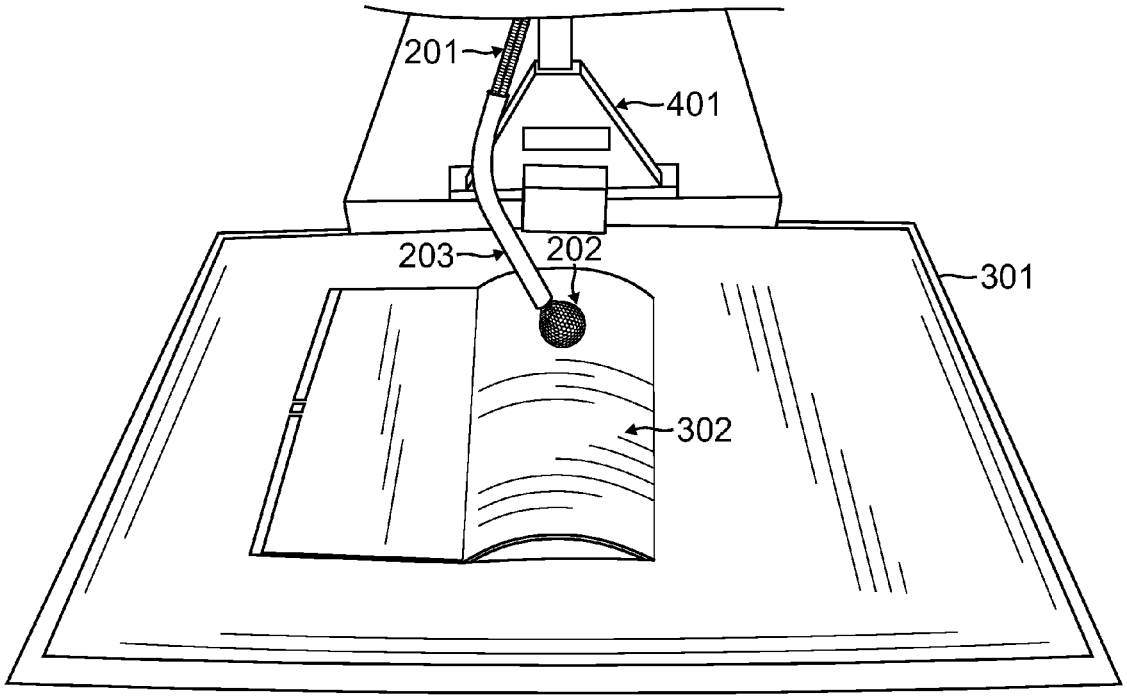
FIG. 5 is an enlarged front perspective view of one embodiment of base member 301 showing a raised impact area 302.
Figures 6A, 6B:
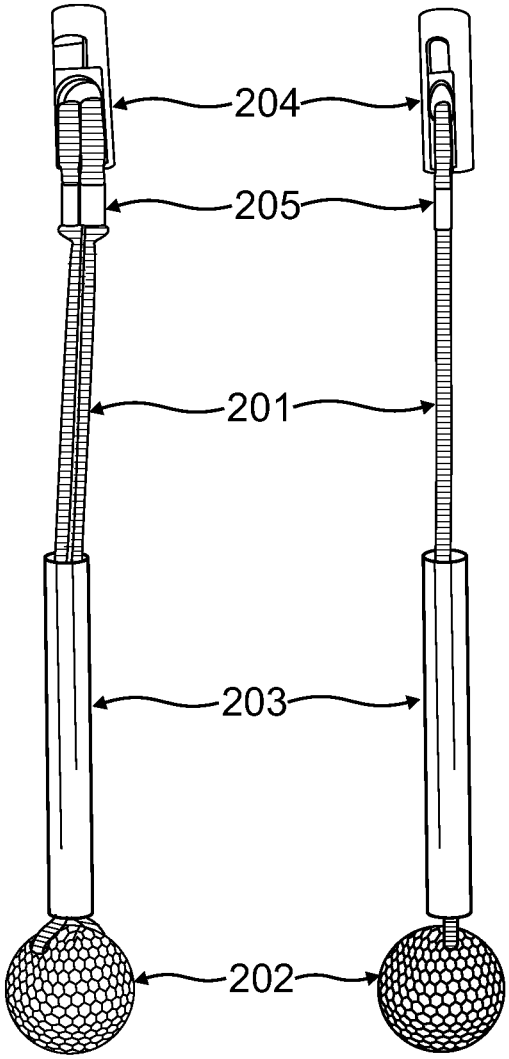
FIG. 6A is an enlarged front elevational view of one embodiment of elongated cord 201 and golf ball 202 and FIG. 6B is a side elevational view thereof.
Figure 8:
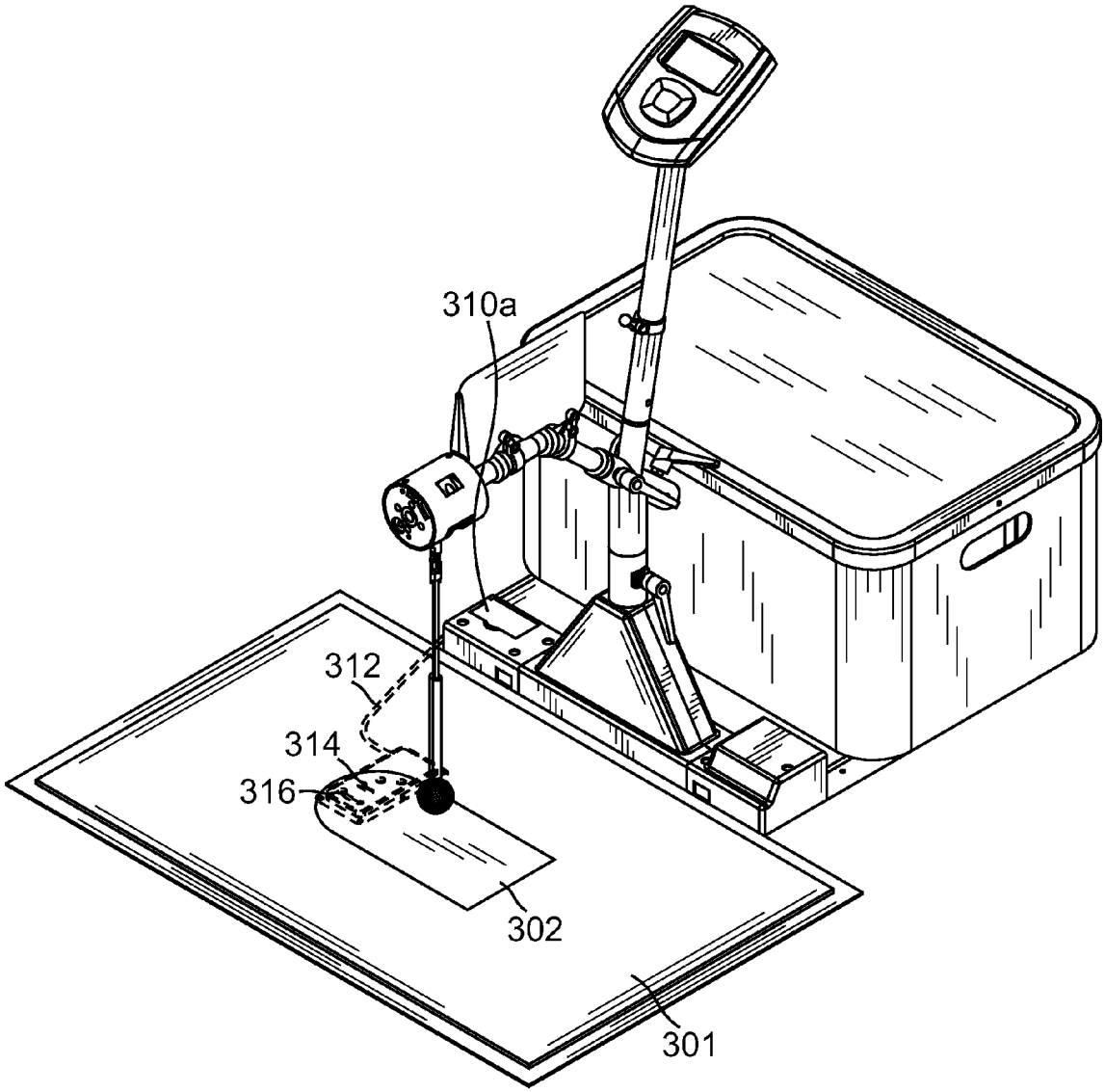
FIG. 8 is perspective view demonstrating the positioning of a slide mechanism 314 positioned underneath an impact area 302.

As shown in FIGS. 5 and 8, in some embodiments, preferably base member 301 includes a raising means capable of raising impact area 302, wherein the raising means raises impact area 302 after golf ball 202 is struck by the user to interrupt the rotation of golf ball 202. Preferably, the raising means raises impact area 302 after golf ball 202 has made several revolutions. This can be accomplished by including programming which counts rotations or revolutions of the drum 101 and thus upon equaling a predetermined value the impact area 302 is raised. Counting revolutions can be performed by counting the passing of a magnet 110*b* with a magnet sensor 110*a* as shown in FIG. 2. Alternatively, once rotation begins a timer may provide a timed delay for initiating raising the impact area 302. In any event, a raised impact area 302 is provided to slow or stop the golf ball 202 and sets it for the next swing. Accordingly, the user need not move from his stance between swings. FIGS. 1, 2, and 5 show impact area 302 in a raised position. FIG. 5 shows raised impact area 302 interrupting the rotation of golf ball 202 after golf ball 202 has made several revolutions. Generally the raising means lowers the impact area 302 after a predetermined time period, which in some embodiments can be increased or decreased through programmed menu options offered to the user. In other embodiments the impact area 302 is lowered once rotation of the drum 101 meets a predetermined rotational threshold. For instance, once the drum 101 stops rotating or sufficiently reduces rotational speed, the impact area 302 may be lowered. This can be accomplished by timing rotations or by detecting when rotation has stopped or substantially slowed. Consistent with prior descriptions, monitoring rotation can be accomplished using a magnet sensor 110*a* that detects the rotational passing of a magnet 110*b* as shown in FIG. 2.

In some embodiments, the impact area 302 is a three-sided flap cut out from a center portion of the top layer of base member 301. In some embodiments, a means for raising the impact area 302 includes an elastic band which is attached to the underside left end of the flap. The elastic band stretches across base member 301 (the right end) and anchored. The tension of the elastic band causes the flap to bow upwards in the center.

Figure 9B:
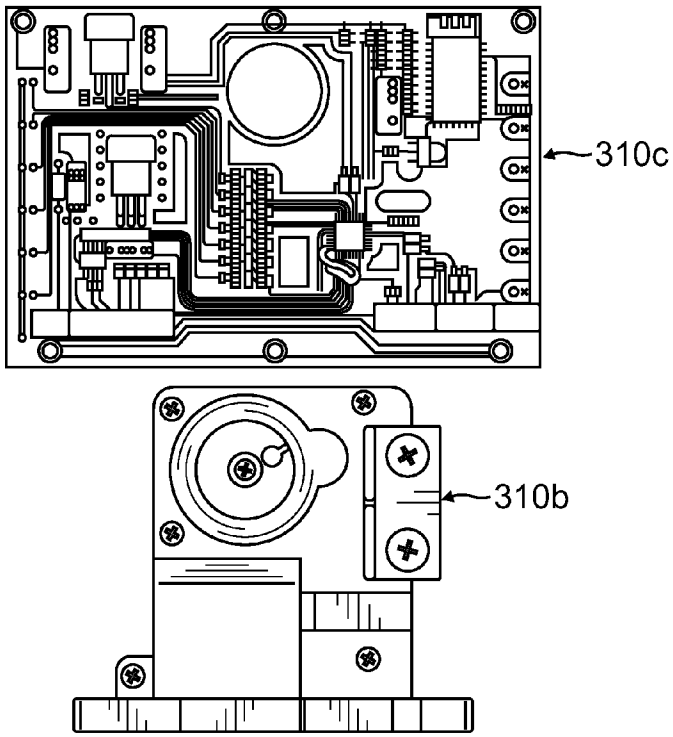
FIG. 9B depicts a motor 310*b* coupled to motor circuitry 310*c*.
Figure 9A:
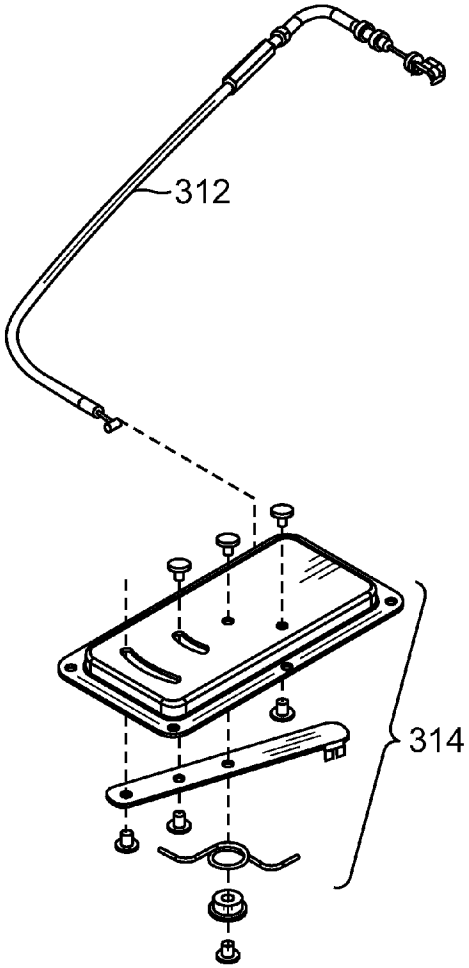
FIG. 9A is a schematic showing a slide mechanism 314 and cable 312.
Figure 10:
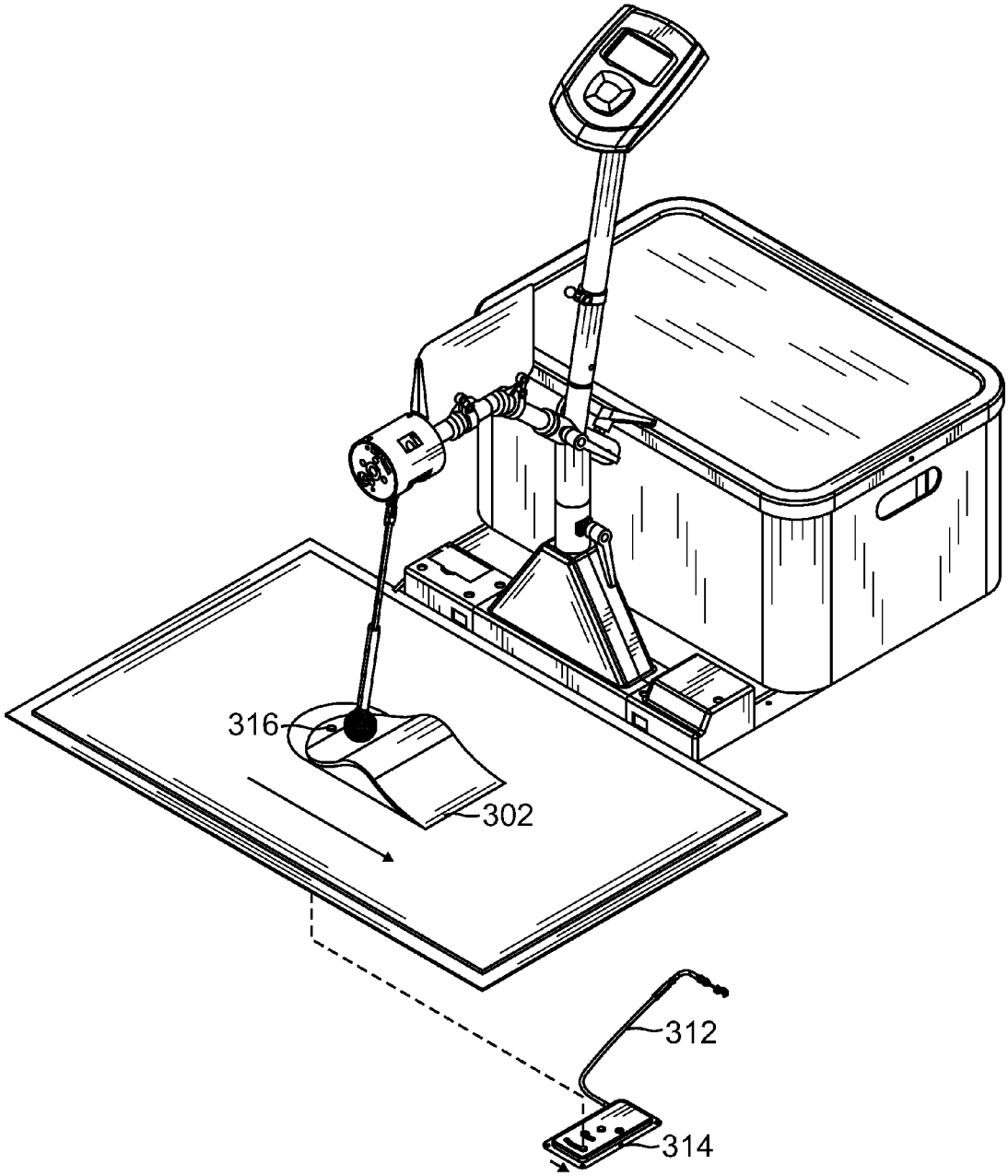
FIG. 10 is a perspective view demonstrating a raised impact area 302.
Figure 11:
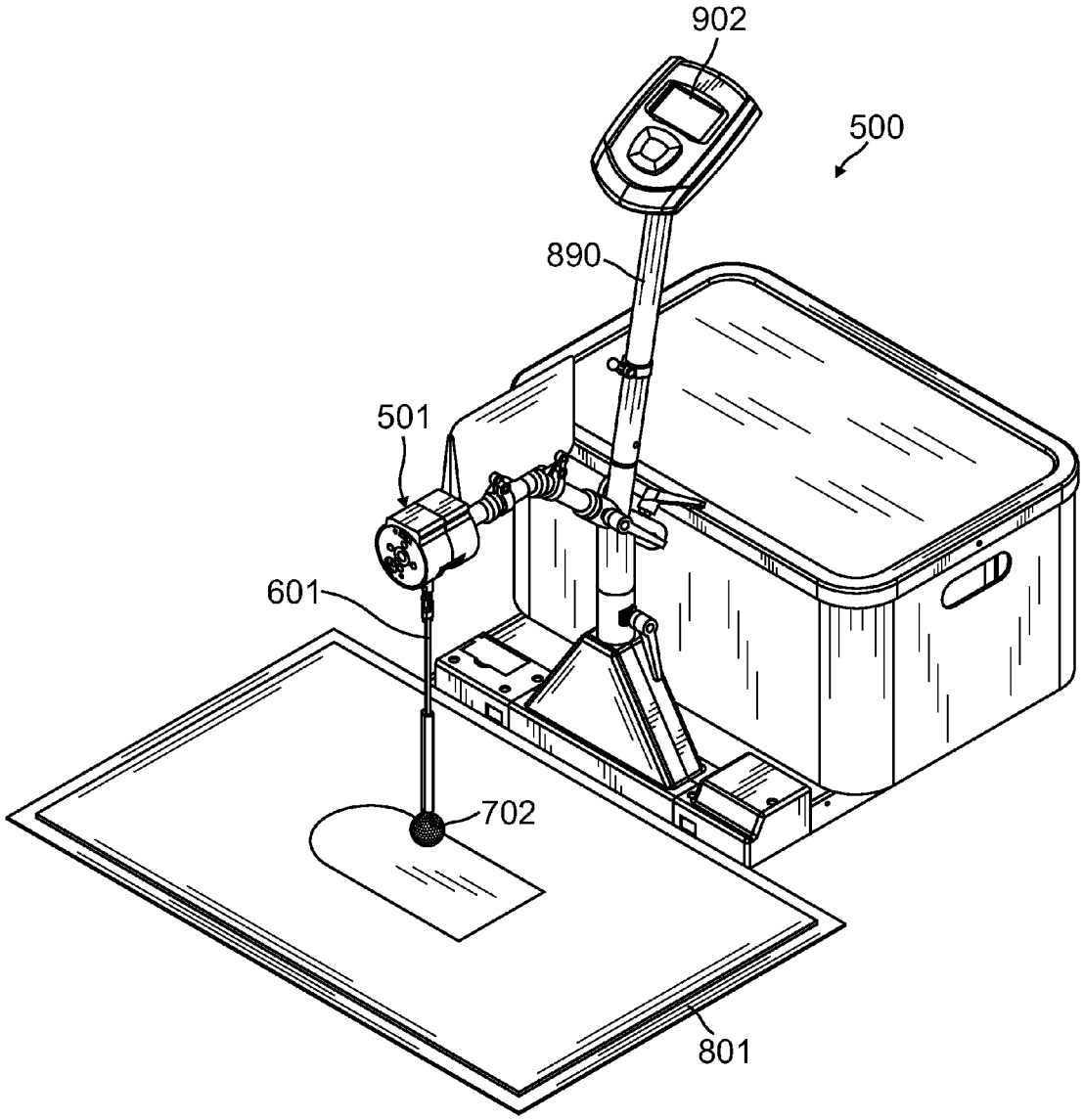
FIG. 11 is a perspective view of another embodiment of a golf apparatus 500 including optical drum 501.

FIGS. 8-10 depict a preferred approach to regulating the raising and lowering of impact area 302. Specifically, a means for raising the impact area can include a motor 310*b* stored in a motor housing 310*a* that is attached to a cable 312, which itself runs from the motor 310*b* underneath or within base member 301 to a slide mechanism 314 that is mounted to the base member 301, and underneath the impact area 302. The slide mechanism 314 includes attachment site 316, which attaches to the flap at the impact area 302. As shown in FIG. 8 and in view of FIGS. 9A and 9B, when the motor circuitry 310*c* is not activated (off position) the motor cable 312 is unwound or spooled out, which releases the slide mechanism 314 to the left, thus flattening the bow and lowering the flap to a flat position, flush with the rest of the top layer of base member 301 thereby forming a flat impact area 302. When the motor circuitry 310*c* is activated, the cable 312 is wound tight by the motor 310*b* thereby increasing tension of the slide mechanism 314 and thus the flap is pulled to the right at the attachment site 316 which causes the flap to bow upwards and raise the impact area 302. The skilled artisan will appreciate variations exist for the means for raising the impact area 302. For example, suitable mechanisms can be formed using various levers, springs and the like, which provide substantially the same effect and thus would also be encompassed by the invention.

Returning to FIGS. 1 and 2, in some embodiments, the invention includes a ballast, preferably in the form of a water tank 303, secured to base member 301 to provide stability to the frame structure when water tank 303 is filled with water. Preferably, water tank 303 is a specially designed 17 gallon water container which securely anchors base member 301 to the ground or floor when filled to accommodate the centrifugal forces on the ball-tether system. The combined weight of base member 301 and 17 gallons of water provides over 170 lbs of weight to offset the impact and centrifugal forces of a 145 mile per hour swing. The container is easy to fill and empty, facilitating the transport of the present invention from place to place, such as from the basement or garage out to the patio or lawn. Naturally, one could also place other media in the water tank 303 such as sand, gravel and the like or provide other means for reducing movement of the apparatus; however, water tends to be the preferred media and approach. The water tank also doubles as a packaging box or space, where all of the device's disassembled parts and components can be placed or packaged, for storage or shipping.

Figure 14:
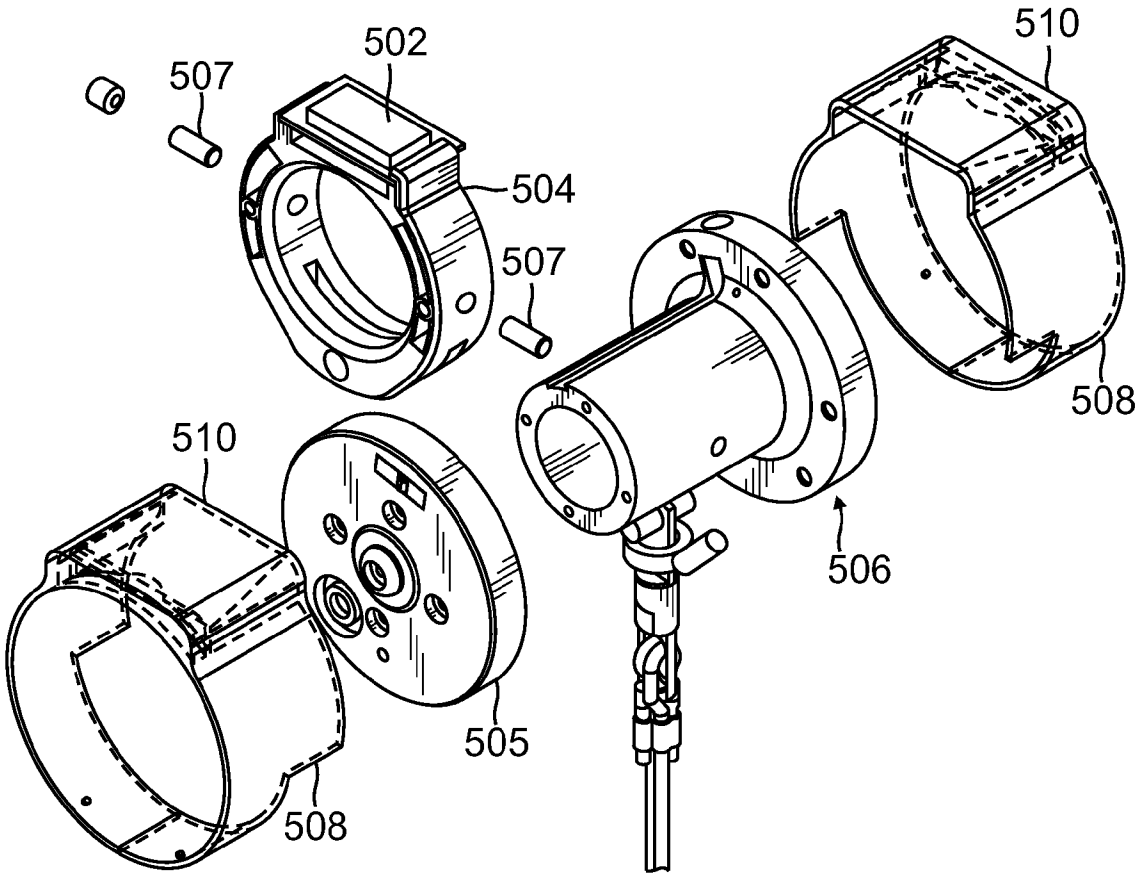
FIG. 14 is a partially exploded schematic depicting the drum core 506 with swivel ring 504, end cap 505 and cover 508.

In another aspect of the invention a golf apparatus 500 is provided substantially as shown in FIGS. 11-18, which includes a rotating optical drum 501, an elongated cord 601, a golf ball 702, a base member 801, a consol 902 and a frame structure 890. As shown in FIGS. 12A and 12B, within optical drum 501 is an optical sensor 502, which as shown in FIG. 14 is positioned along a swivel ring 504, which itself is positioned around and mounted to drum core 506 by pins 507 (also shown in FIG. 13), which permit swiveling of the swivel ring 504 in a direction that is perpendicular to the rotational direction of the optical drum 501.

Figure 15B:
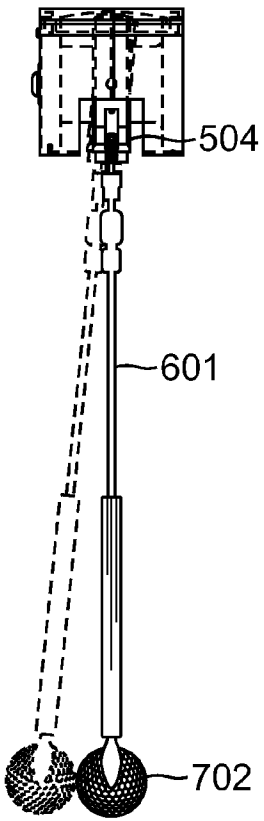
FIG. 15B is a schematic showing swivel of a ball 702 and elongated cord 601.
Figure 15A:
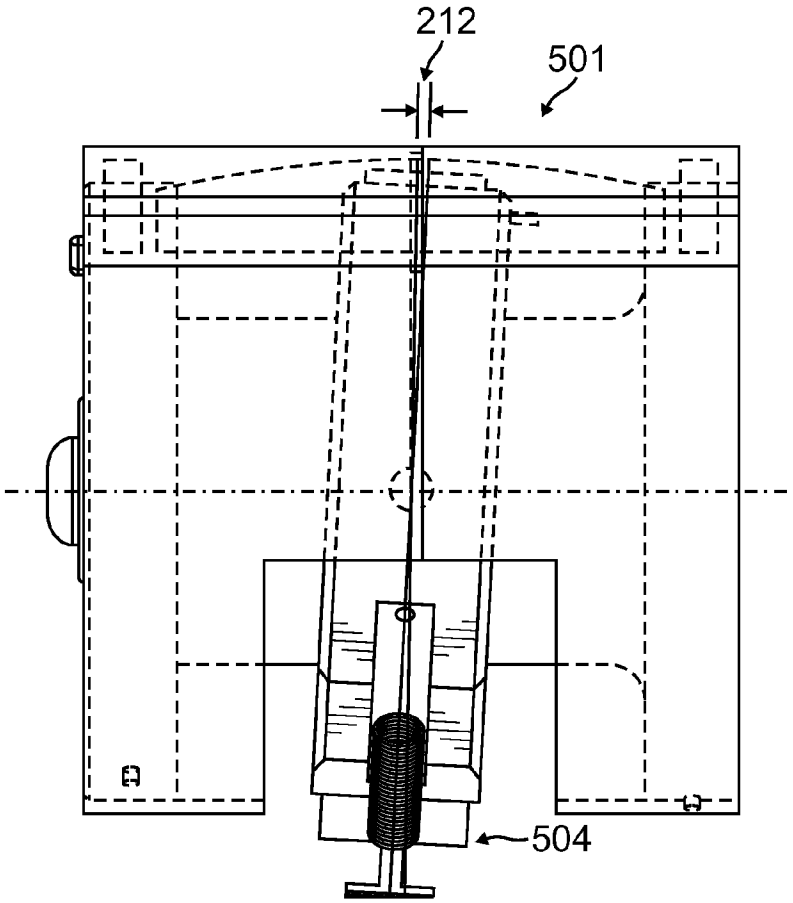
FIG. 15A is an elevational view of an optical drum 501 showing a swivel ring 504 and swivel distance 212.

As can be seen in FIGS. 15A and 15B, striking ball 702 with an open or closed club face causes ball 702 to move either left or right from a center path. Left or right movement of ball 702 is transferred through the elongated cord 601 causing swivel ring 504 to swivel either left or right in a direction opposite the ball 702 and along an arc path. Swiveling of the swivel ring 504 causes optical sensor 502 to rotationally swivel in combination with swivel ring 504. Turning back to FIG. 14, swiveling of optical sensor 502 occurs in relation to drum cover 508. Accordingly, by tracking movement across drum cover 508, such as along an arc path of a drum slot 510 optical sensor 502 is capable of detecting a swivel distance 212 as shown in FIG. 15A thereby permitting calculation of a swivel angle and thus a trajectory vector of a ball 702 that differs from the rotational direction of the drum 501. Accordingly, swivel angle can be used to calculate overall theoretical ball trajectory or the degree at which a club face is open or closed.

The skilled artisan will appreciate that as the optical drum 501 continues to rotate, the angle from center or the arc length will continue to lessen. As such, in a preferred embodiment, the maximum value corresponding to the maximum swivel angle or maximum off center ball trajectory is saved for display. This can be accomplished by measuring or recording the swivel that occurs during the initial rotation of the optical drum 501. In some embodiments, a swivel is measured during a second rotation. In other embodiments a swivel is measured during a third rotation. In still further embodiments, the swivel is measured during two or more complete rotations and averaged to provide an average angle or average degree off center value. The skilled artisan will appreciate swivel measurement or detection can be initiated upon detection of rotation of the drum 501, such as by incorporating a magnet sensor 110*a* that detects the passage of a rotating magnet 110*b* as shown in FIG. 2.

Optical sensor 502 may be formed in any suitable way, which permits optical sensor 502 to detect movement across drum cover 508. In preferred embodiments, drum cover 508 includes a slot 510 that accepts optical sensor 502. In preferred embodiments, optical sensor 502 includes a diode, such as a LED or laser diode to emit light against the inner surface of the drum cover 508. The optical sensor 502 also preferably includes a corresponding sensor means to detect the emitted light thereby detecting movement of the optical sensor 502 and thus permitting ball flight angle to be accurately determined.

In some embodiments the optical sensor 502 is an optoelectronic sensor that operates akin to a video camera that takes rapid sequential images of the inner surface of the drum cover 508 and using digital image correlation, detects naturally occurring texture variations in materials or detects changes in a printed surface across the drum cover 508 and thereby is able to determine or measure the amount of swivel of the optical sensor 502 across the drum cover 508. High speed camera imaging and digital image correlation is improving rapidly and thus such advances can easily be adapted into the optical drum 501. Further, these technologies can be adapted from a variety of optical mouse technologies used in the computer arts, which track movement of the mouse across a surface, such as a desk. In related embodiments the optical sensor 502 detects shifts in wavelength of an emitted light due to the swiveling of the optical sensor 502 along the inner surface of the optical drum 501. In preferred embodiments the inner surface is reflective to enhance reflection of the emitted light.

Figure 12A:
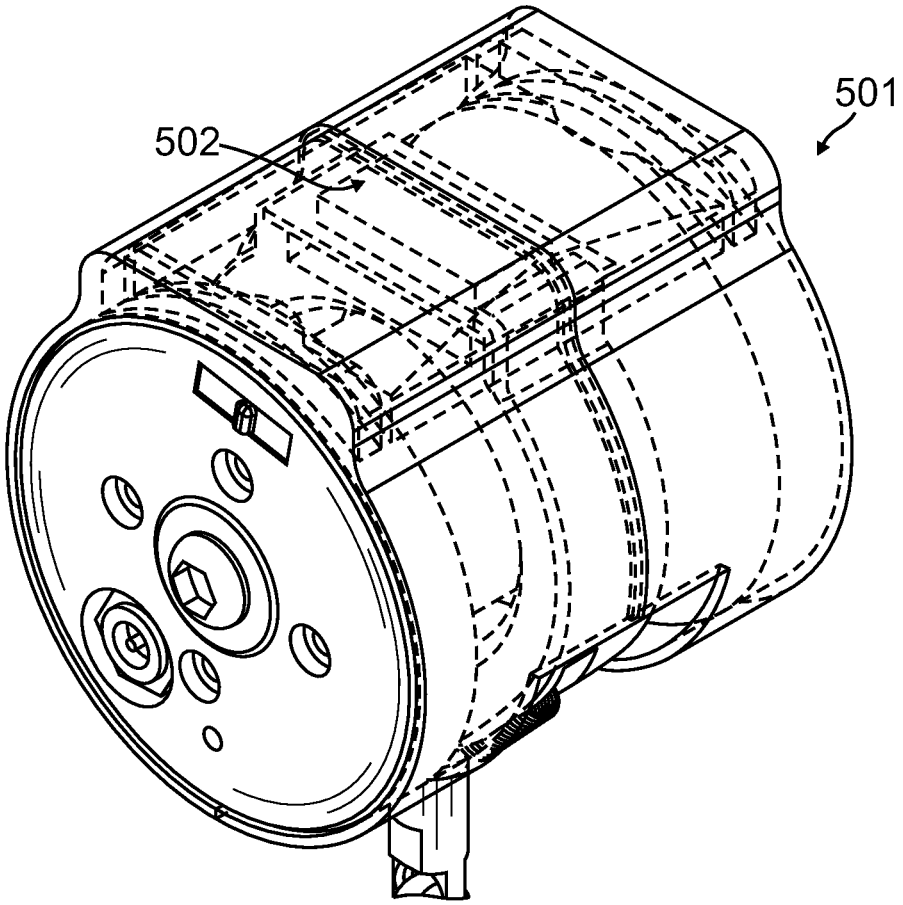
FIG. 12A is a perspective view of an optical drum 501 showing the inner optical sensor 502.
Figure 12B:
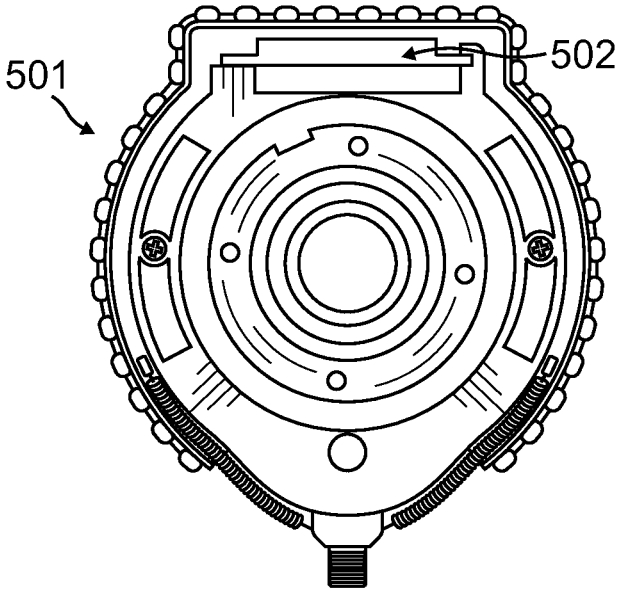
FIG. 12B is a cutaway view of an optical drum showing an optical sensor 502.
Figure 12C:
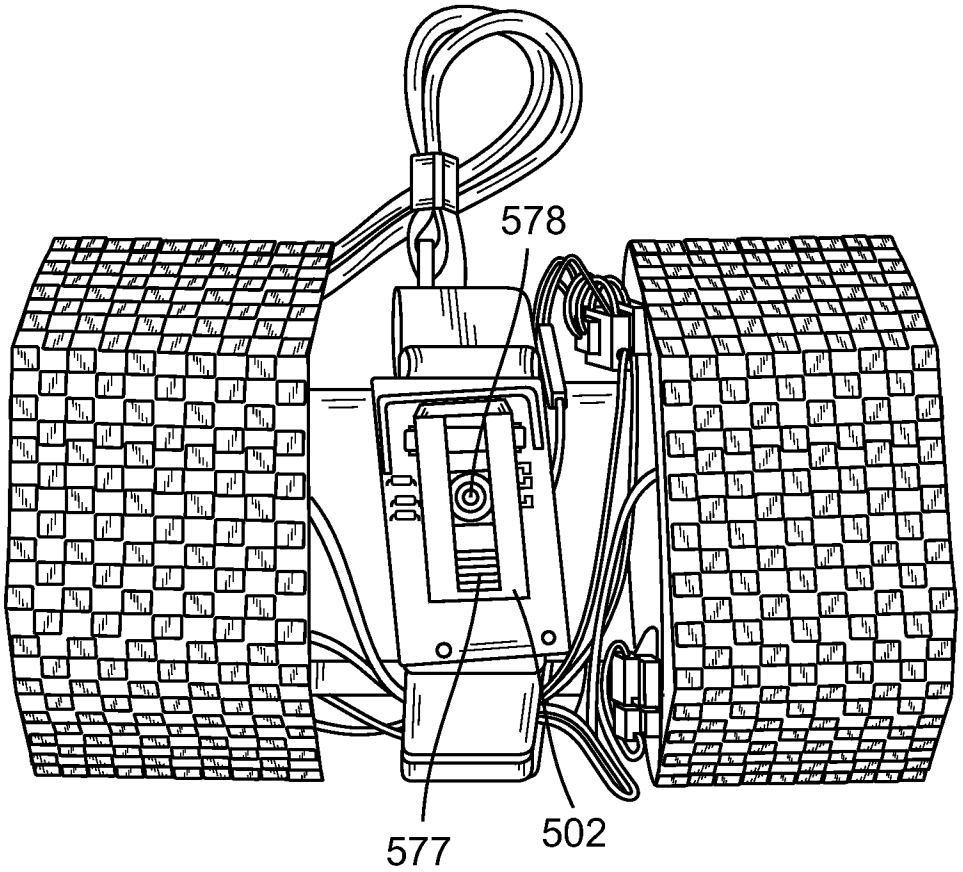
FIG. 12C is an exploded view of the optical drum showing the optical sensor 502.
Figure 12D:
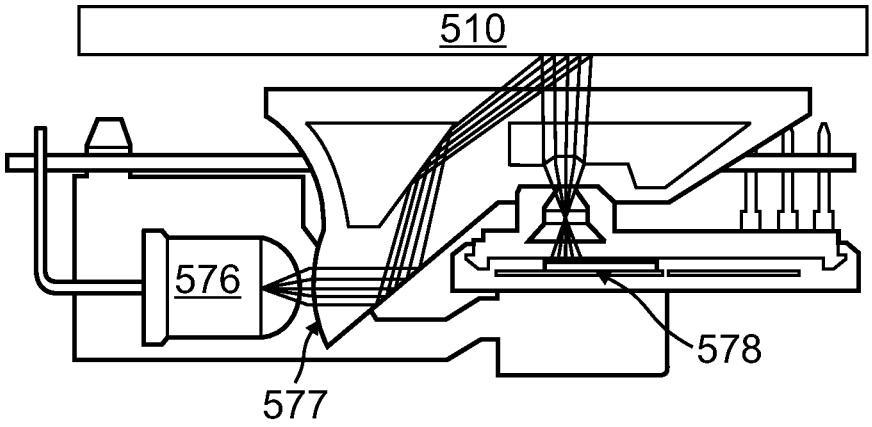
FIGS. 12D and 12E are schematics depicting operation of the optical sensor 502 against a reflective drum slot 510.
Figure 12E:
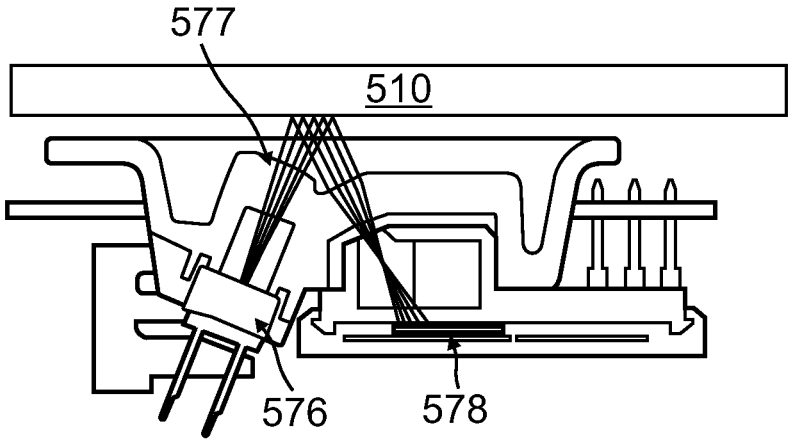
Figure 13:
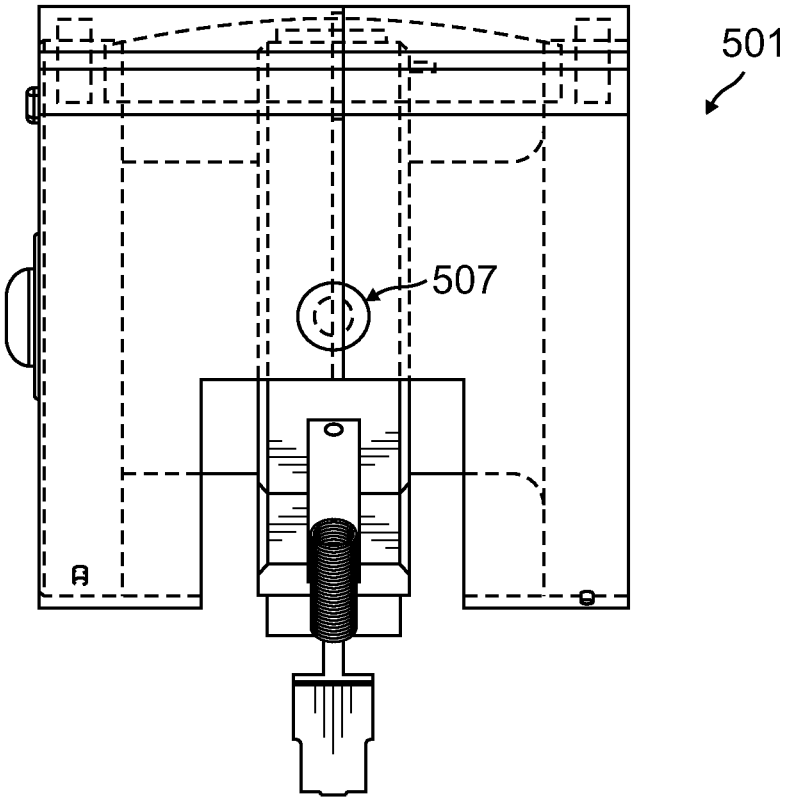
FIG. 13 is a front elevational view of an optical drum 501 showing pin 507.

The skilled artisan will appreciate there are a number of variations to optical tracking methods and sensors, which can be used with the present invention. Preferred approaches are shown in FIGS. 12C through 12E, the optical sensor 502 preferably includes a small emitting light source 576, such as a LED, red in color. The LED emits light, preferably through a collimating lens 577, which then bounces or is reflected off a reflective surface, such as the slot 510 along the drum cover 508 and is detected by a complementary metal oxide semiconductor (CMOS) sensor 578. The CMOS sensor 578 sends each image reflected back to a digital signal processor (DSP) for analysis. Using thousands of images that the CMOS 578 sends to the DSP for analysis, the DSP is able to detect both patterns and images and can determine if the optical sensor has moved, at what distance it has moved and at what speed. The DSP can also determine coordinates that are then sent to the processor that the optical sensor 502 is hooked up to, such as within the drum 501 or preferably within the consol 902. Such technologies can be adapted from optical mouse technologies used in the computer arts.

There are many benefits to using an optical based system to determine ball trajectory. For example, the optical sensor 502 has no moving parts, which increases reliability. Measuring movement using an optical sensor also provides a high degree of precision with recent improvements in optical tracking technologies.

Figure 16:
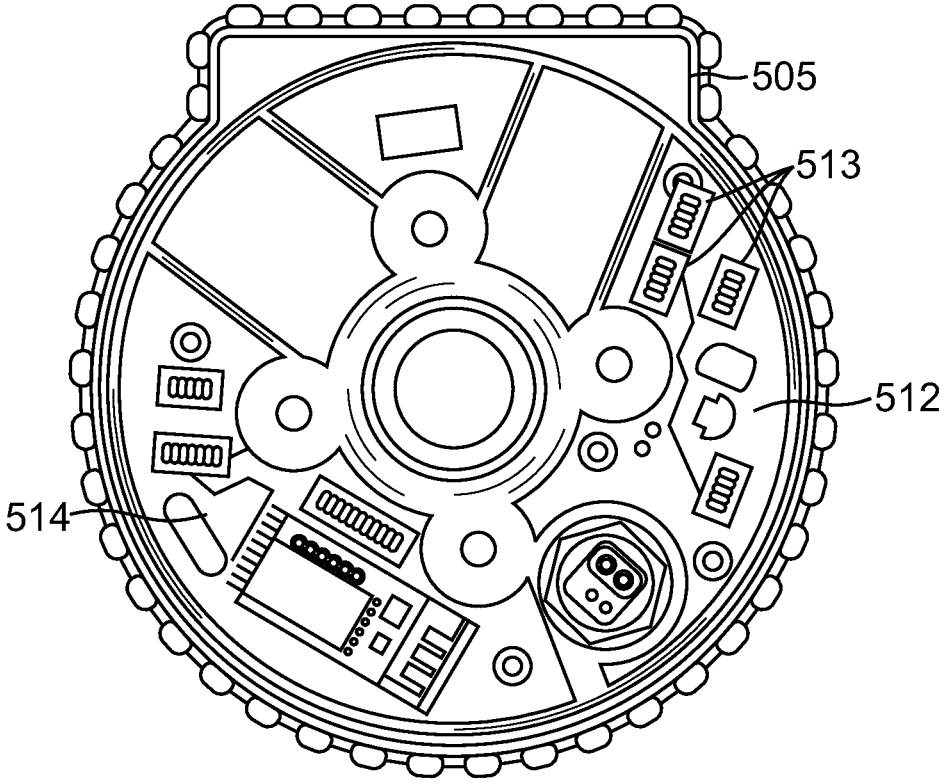
FIG. 16 is a cutaway view showing end cap 505 with drum circuitry 512.
Figure 17A:
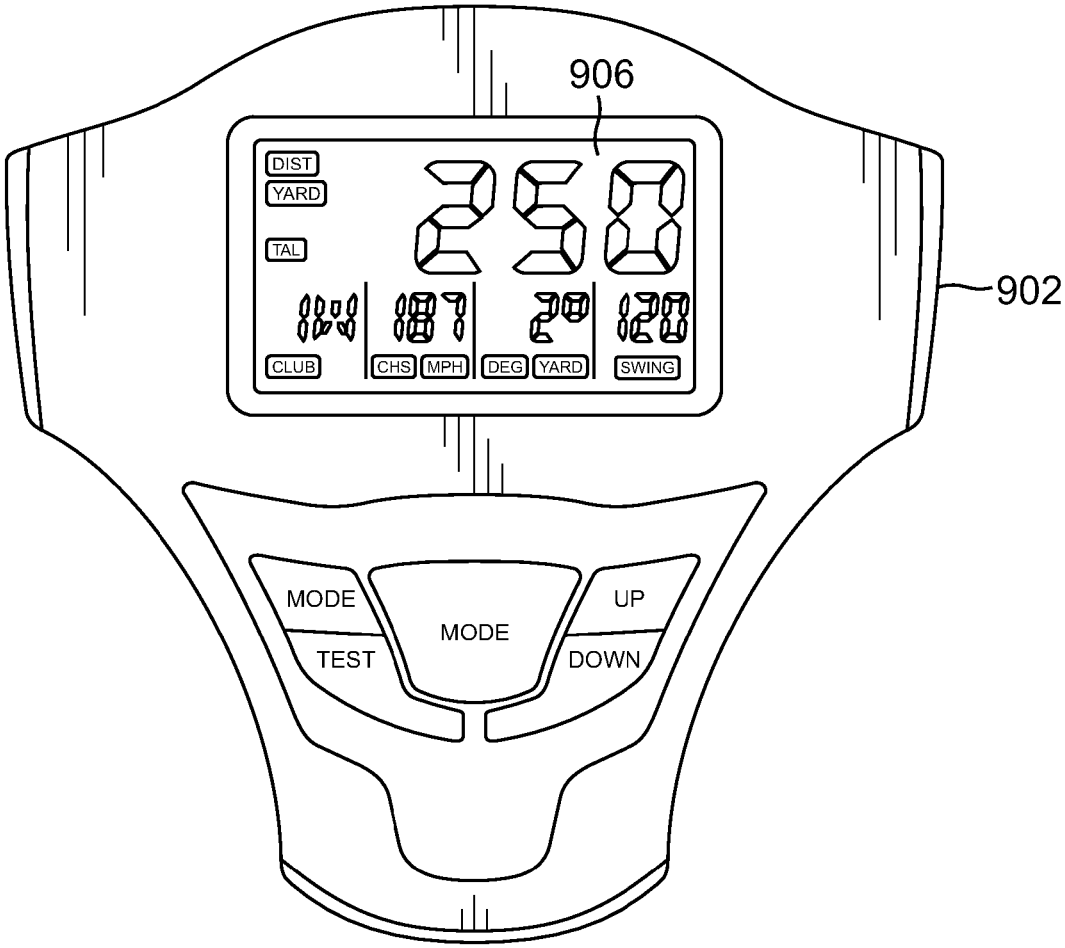
FIG. 17A is a front elevational view of a consol 902.
Figure 17B:
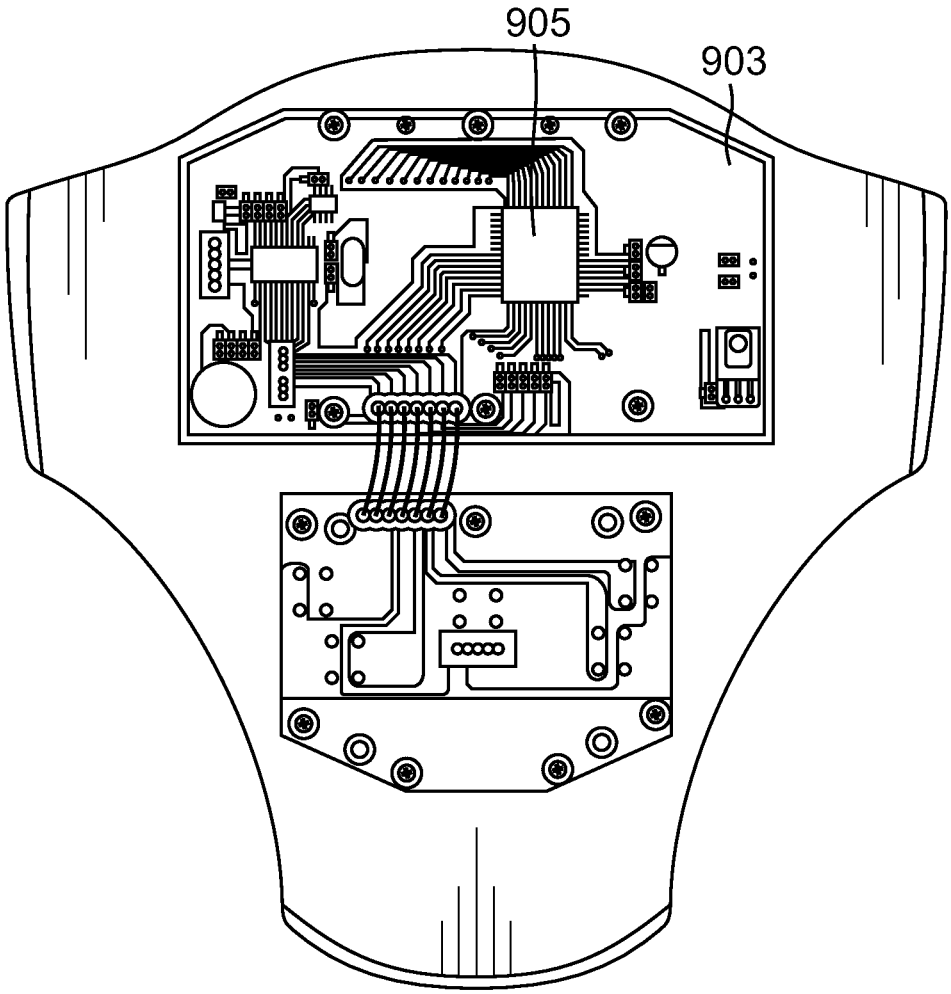
FIG. 17B is a cutaway view showing consol circuitry 903.
Figure 17D:
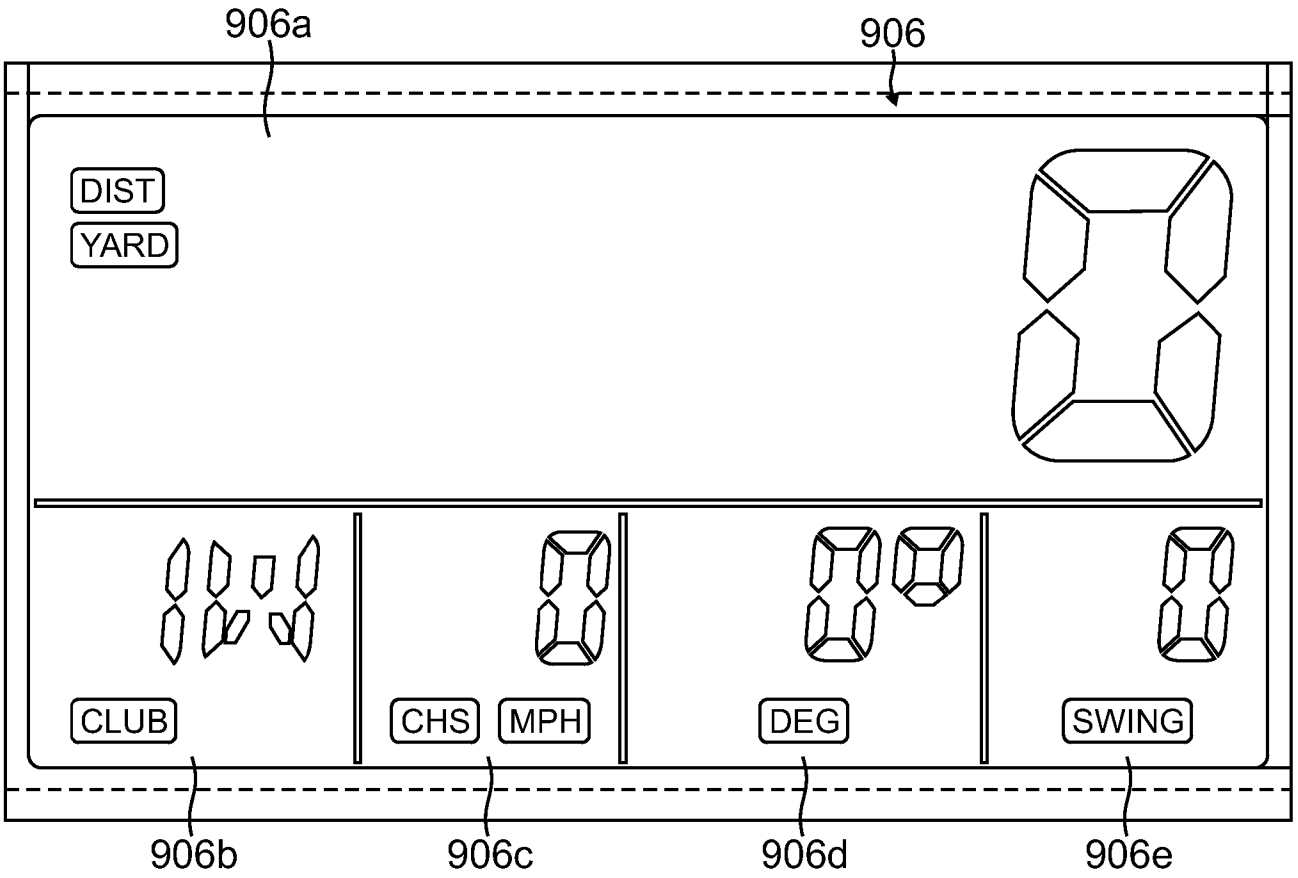
FIG. 17D shows a display screen 906.
Figure 18:
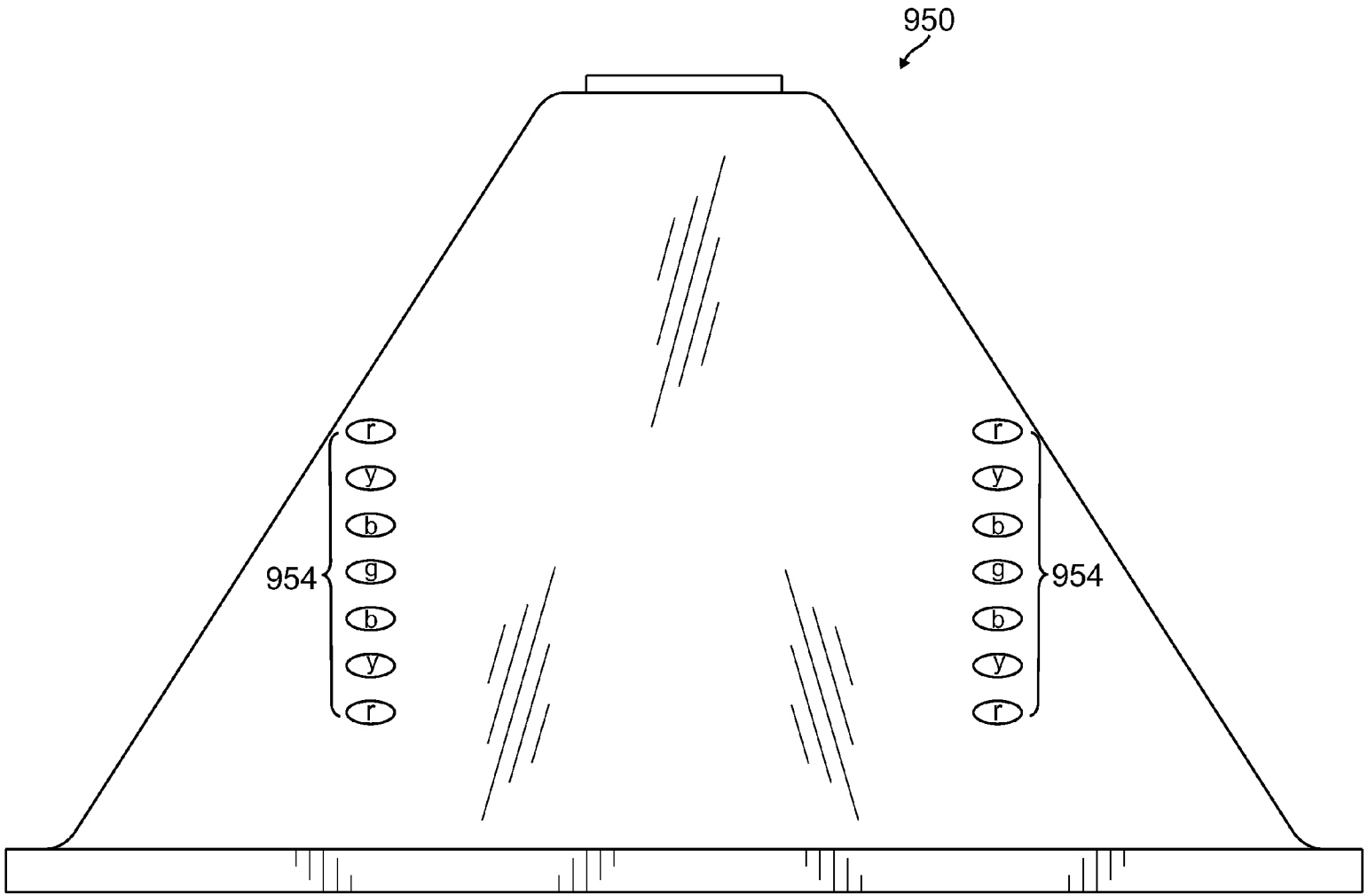
FIG. 18 is a front elevational view of the frame base 950 with LEDs 954.

As shown in FIG. 14, preferably the optical drum 501 also includes an end cap 505, which as shown in FIG. 16 may include drum circuitry, which itself includes a power source PCB 512 for supplying power to components within the drum 501 through power communication plugs 513, such as to a wireless data transmitter 514 such as Bluetooth or other data frequency transmitters, the optical sensor 502, and the like. The drum circuitry can also have a processor such as to process data from the optical sensor 502 or process rotational data, memory, batteries and the like. In some embodiments swing data can be stored in the drum 501 and downloaded to a remote computer for further analysis, data plotting in the form of graphs or the like using suitable software. In preferred embodiments trajectory data measured using the optical sensor 502 is transmitted wirelessly from the wireless data transmitter 514 to a consol 902, which as shown in FIGS. 17A-17C, can include consol circuitry 903 which can include a wireless receiver, a processor 905, memory, power supply, such as battery and the like. The skilled artisan will appreciate that since ultimately degree off center will be displayed using data from the optical sensor 502 such calculations can be performed by the drum circuitry if equipped with a suitable processor followed by transmission to the consol 902. Alternatively data can be transmitted by the wireless transmitter 514, received by the consol 902 and the consol can perform any needed trajectory calculations using the processor 905 within the consol circuitry 903. Such calculations can be performed using mathematical equations that consider the swivel angle, rotation speed, acceleration and direction, ball plane or the like as known in the computational arts. The skilled artisan will appreciate that the consol 902 can communicate with the drum 501, the magnet sensor 110*a*, the means for raising the impact area and the like to coordinate or instruct any needed operations and to make any needed calculations. As eluded to, consol 902 also includes a display screen 906, which depicts various readouts, such as ball flight distance 906*a*, club identifier 906*b*, club head speed (CHS) 906*c*, degree off center 906*d*, total number of swings per session 906*e* and the like. The skilled artisan will appreciate that the consol 902 may permit the user to switch across various programming modes, select user data or average data and the like for further statistical analysis. In addition, by loading course information into memory of the consol circuitry 903, such as distances, widths and like, which themselves can be modeled from global position satellite (gps) coordinates, the user can simulate playing any course. Accordingly, in some embodiments the display simulates a theoretical position on a simulated golf course, which can be updated with each swing by sequentially comparing or plotting ball vector information to a loaded map.

To further assist the user in recognizing the accuracy of ball strike, the frame base 950 may include a plurality of indicator lights, such as LED indicators 954, which visually signal the degree at which the ball trajectory is off center. Non-limiting ranges contemplated can be between 0.25 to 5 degrees per LED position with 0.5 to 2.5 being preferred and 1 degree being most preferred. For instance, if the user hits the ball 702 square, a center green LED pair 954*g* will illuminate and the console display screen 906 will display a plus or minus angle from 0-2 degrees in a degree off center data 906*d* field. If the user hits the ball right 3 degrees, the console display screen 906 will display 3 degrees in the degree off center 906*d* field and the blue LED 954*b* will illuminate. As a further example, if a right handed hitter hits the ball 4 degrees to the left, the console display screen 906, will display −4 degrees in the degree off center 906*d* data field and the yellow LED 954*y* will illuminate. The red LED 954*r* indicates anything over 5 degrees, or OB or out of bounds.

The skilled artisan will appreciate that a means of measuring the speed of rotation or acceleration of the optical drum 501, which can be used to measure club head speed or predict a corresponding ball distance, can be accomplished using a variety of approaches such as by securing a suitable magnet in the optical drum 501 and a magnet sensor secured to the frame structure. Alternatively gearing can be joined to the drum 501, such as on the drum core 506 to measure rotation or rotational speed. The skilled artisan will appreciate that rotational speed or acceleration can be converted to club head speed, a theoretical distance and when combined with vector information from the optical sensor 502 further detailed positioning can be determined such as distance from center of fairway, distance from pin, landing in virtual rough, sand trap, lake, hazard and the like. This theoretical spatial position can be calculated in consideration of vectors incorporating rotational speed and swivel angle and applying the results to a mapped course defined by Cartesian coordinates. Cartesian coordinates corresponding to a simulated golf course can be generated from gps coordinates of a known golf course as known in the computational arts. Thus, theoretical position can be compared with simulated course maps and the like.

Having described the invention in detail, it will be apparent that modifications, variations, and equivalent embodiments are possible without departing the scope of the invention defined in the appended claims.

What is claimed is:

1. A golf swing practice apparatus that provides ball trajectory information comprising:

(a) a rotating drum comprising an optical sensor mounted inside the drum that is capable of swiveling in a direction perpendicular to the rotational direction of the drum and capable of detecting a change in swivel position or swivel angle;

(b) an elongated cord comprising a proximal end secured to the drum and a distal end secured to a golf ball;

(c) a base member having an impact area over which a user may swing a golf club;

(d) a frame structure secured to the base member and to the rotating drum whereby the frame structure holds the rotating drum in an elevated position above the impact area and provides an axis for the rotational direction;

(e) a means for measuring rotation speed of the rotating drum; and (f) a console comprising a display screen for displaying swing data and a processor operably connected to the optical sensor and the means for measuring rotation speed to receive swivel and rotation data and for communicating the swing data to the display screen.

2. The golf swing practice apparatus of claim 1, wherein the optical sensor detects the change in swivel position or swivel angle by detecting movement across an inner surface of the rotating drum.

3. The golf swing practice apparatus of claim 1, wherein the optical sensor is mounted to a swivel that encircles and is mounted to a drum core.

4. The golf swing practice apparatus of claim 1, wherein data from the optical sensor is wirelessly transmitted to the console.

5. The golf swing practice apparatus of claim 4, wherein the console displays an approximate angle at which the ball left the user's club head.

6. The golf swing practice apparatus of claim 5, further comprising a series of light emitting diodes (LEDs) that display the predicated trajectory information by selectively lighting different LEDs according to different ball angles.

7. The golf swing practice apparatus of claim 1, further comprising a means for raising the impact area after the golf ball is struck by the user to interrupt rotation of the golf ball.

8. The golf swing practice apparatus of claim 1, wherein the processor computes a theoretical spatial location relative to a simulated fairway to which the golf ball would travel.

9. The golf swing practice apparatus of claim 1, wherein the swing data comprises one or more selected from the group consisting of distance, club had speed, and degree off center.

10. The golf swing practice apparatus of claim 1, wherein the means of measuring the rotation speed comprises:

(a) a magnet secured to the rotating drum; and (b) a magnet sensor secured to the frame structure, wherein the magnet sensor monitors the rotational passage of the magnet.

11. A drum for use in a golf swing practice apparatus, comprising:

(a) a drum core;

(b) a swivel ring positioned around the drum core and capable of swiveling perpendicular to a rotational direction of the drum, wherein the swivel ring comprises an optical sensor capable of detecting a change in swivel position or angle;

(c) a tether means for tethering a golf ball to the center swivel ring; and (d) wireless or electronic circuitry to electrically transmit the change in swivel position to a receiver.

12. A base member for use in a golf swing practice apparatus, comprising:

(a) an impact area at least partially detached from a surrounding golf base, wherein the impact area is switchable between two orientations, the first orientation being on a same plane as the surrounding base to provide a surface for impacting a golf club during a golf swing and the second orientation being at least partially raised above the surrounding base to stop or slow a golf ball after impact; and (b) a means for raising the impact area from the first orientation to the second orientation after impact.

13. The drum of claim 12, wherein the drum core comprises an attachment means at a center of the drum core for rotational engagement with a frame structure.

14. The base member of claim 12, wherein the impact area comprises a retractable center flap attached to an attachment site on the means for raising the impact area.

15. The base member of claim 12, wherein the means for raising the impact area comprises an electric motor.

16. The base member of claim 12, wherein the impact area is configured to slide along the base when switching between the two orientations.

17. The base member of claim 12, wherein means for raising the impact area is coupled to a spring.

* * * * *